United States Patent [19]

Aonuma et al.

[11] 4,059,463

[45] Nov. 22, 1977

[54] PROCESS FOR PRODUCING FERROMAGNETIC POWDER

[75] Inventors: Masashi Aonuma; Tatsuji Kitamoto; Goro Akashi, all of Odawara, Japan

[73] Assignee: Fuji Photo Film Co., Ltd., Minami-Ashogara, Japan

[21] Appl. No.: 693,669

[22] Filed: June 7, 1976

Related U.S. Application Data

[63] Continuation-in-part of Ser. No. 326,358, Jan. 24, 1973, abandoned, which is a continuation of Ser. No. 552,013, Feb. 24, 1975, abandoned.

[30] Foreign Application Priority Data

Jan. 27, 1972 Japan ..... 47-10389

[51] Int. Cl.[2] ..... H01F 1/02

[52] U.S. Cl. ..... 148/105; 75/.5 AA; 148/31.55; 148/108

[58] Field of Search ..... 148/105, 108, 31.55, 148/31.57; 75/.5 AA; 427/127, 132; 252/62.55

[56] References Cited

U.S. PATENT DOCUMENTS

| | | | |
|---|---|---|---|
| 3,206,338 | 9/1965 | Miller et al. | 148/105 |
| 3,607,218 | 9/1971 | Akashi et al. | 75/.5 AA |
| 3,661,556 | 5/1972 | Jolley et al. | 75/.5 AA |
| 3,669,643 | 6/1972 | Bagley et al. | 75/.5 AA |
| 3,672,867 | 6/1972 | Little et al. | 75/.5 AA |
| 3,756,866 | 9/1973 | Parker et al. | 148/105 |

*Primary Examiner*—Walter R. Satterfield

*Attorney, Agent, or Firm*—Sughrue, Rothwell, Mion, Zinn and Macpeak

[57] ABSTRACT

Ferromagnetic powders comprising cobalt and/or nickel are produced by reducing cobalt and/or nickel salts in an aqueous solution containing hypophosphite ions while applying a magnetic field.

18 Claims, No Drawings

PROCESS FOR PRODUCING FERROMAGNETIC POWDER

CROSS REFERENCE TO RELATED APPLICATIONS

The above-identified application is a continuation-in-part of Ser. No. 326,358, filed Jan. 24, 1973, now abandoned, which in turn is a continuation of Ser. No. 552,013, filed Feb. 24, 1975, also abandoned.

BACKGROUND OF THE INVENTION

1. FIELD OF THE INVENTION

This invention relates to a process for producing powders of ferromagnetic metals, and more particularly to a process for producing powders of ferromagnetic metals having a square hysteresis loop suited for use in magnetic recording tape, a high coercive force and high maximum residual flux density.

2. DESCRIPTION OF THE PRIOR ART

Feroxide ferromagnetic powders, such as $\gamma$-$Fe_2O_3$ and $Fe_3O_4$ hitherto used for producing magnetic recording tape, are not suited for recording signals of ultra-short wave lengths (less than 10 $\mu$) or high density magnetic recording since the coercive force and the maximum residual flux density thereof are insufficient.

Recently, many studies have been made to find ferromagnetic materials having magnetic properties suited for high density magnetic recording. Suitable ferromagnetic metal powders discovered include pure metal powders such as Co powder or Ni powder, and alloy powders composed mainly of at least two metals selected from Co, Ni and Fe.

These ferromagnetic powders are produced by the following known processes:

1. Reducing the oxalate of a metal capable of forming the ferromagnetic body in flowing $H_2$ gas at high temperatures. (see Japanese Patent Publications 11412/61, 22230/61, 8027/65, 14818/66 and 22394/68)
2. Reducing goethite or accicular $\gamma$-$Fe_2O_3$ in flowing $H_2$ gas at high temperatures. (see Japanese Patent Publications 3862/60 and 20939/64)
3. Evaporating a ferromagnetic metal in an inert gas atmophere. (see "Applied Physics" vol. 40, No. 1, p, 110 (1971))
4. Reducing a salt of a metal capable of forming the ferromagnetic body in a solution of the salt using a borohydride. (see Japanese Patent Publications 20116/68 and 26555/63, and "Television", Vol. 19, No. 1, p, 19 (1965))
5. Decomposing a carbonyl of a metal capable of forming the ferromagnetic body. (see U.S. Pats. Nos. 2,983,997, 3,172,776, 3,200,007, and 3,228,882)
6. Electrolytically depositing a ferromagnetic metal using an Hg cathode and separating the deposited metal from Hg by heating. (see Japanese Patent Publications 15525/64 and 8123/65)

According to processes (1) and (2) the volume of the metal powder is decreased during the high temperature reducing treatment, thus causing intergranular voids or aperatures, sintering of the powder, activation of the powder surface and deformation of the powder shape are caused during the reducing treatment at temperatures higher than 300° C in the flowing $H_2$ gas, thus causing irregular dispersion of the ferromagnetic powder in a binder and causing the ferromagnetic powder to exhibit insufficient ferromagnetic properties.

According to processes (1), (2) and (3) the metal powder after the reducing or evaporating treatment poses a danger of ignition due to the highly active powder surface, and accordingly treating and handling of the metal powder are very disadvantageousfrom the commercial viewpoint.

Although wet processes (4), (5) and (6) eliminate the inherent defects of dry processes (1), (2) and (3), the ferromagnetic metal powder obtained, for example by process (4), is accicular and easily broken during mixing and dispersing in a binder, thus lowering the orientation property in a magnetic field. This is observed as an inferior squareness ratio (Br/Bs).

In addition, processes (5) and (6) require careful handling or poisonous and dangerous materials such as metal carbonyls and mercury.

SUMMARY OF THE INVENTION

Therefore, one object of this invention is to eliminate the aforesaid defects and problems in conventional processes and to provide a novel process for producing ferromagnetic metal powder having a square hysteresis loop ratio whereby the coercive force may be easily controlled as desired.

The process of the present invention is characterized in reducing nickel and/or cobalt salts in an aqueous solution which contains hypophosphite ions and an organic solvent while applying a magnetic field to the aqueous solution. While nickel and/or cobalt salts are the main components which form the ferromagnetic product, small proportions of other materials to be incorporated into the ferromagnetic material may be present.

DETAILED DESCRIPTION OF THE INVENTION

The term "salts of metals indispensably containing Co or Ni as the main component and capable of forming the ferromagnetic body" means metal salts containing indispensably Co and/or Ni as the main component and a very low amount of La, Ce, Nd, Sm, Al, S, Cr, Mn, Fe, Cu, Zn and so on, e.g., 0.1 - 10%, preferably 0.1 - 5%, by weight, for improving the magnetic properties. Among these metal salts there can be exemplified sulfates, chlorides, nitrates, formates, acetates, sulfamates and hypophosphates of the metals.

Preferred systems thus comprise 0.1 - 5% by weight of the salts of metals which improve the magnetic properties set out above, balance Co and/or Ni, and, as explained below, low proportion of phosphate derived from the hypophosphite ions present. The invention includes, however, embodiments of Co and/or Ni plus several percent of phosphorous without such metals which improve the powder properties.

According to the process of this invention, these metal salts are dissolved in water and a reducing reaction is conducted in the aqueous solution. The concentration of the aqueous solution must be such that the metal ions in the solution are not in a state of supersaturation. Too high a concentration of the metal ions requires an excess amount of complexing agent and increases the production cost of the ferromagnetic powder. On the other hand, too low a concentration of the metal ions reduces the yield of the ferromagnetic alloy powder and the efficiency of the process. Therefore, the concentration of metal ions the aqueous solution is usually in the range of 0.001 - 1 mol of metal ions per liter, more preferably 0.001 - 0.5 mol/l.

Hypophosphite ion is present in the aqueous solution together with the metal salts. The hypophosphite ion provides the reducing action, and is formed by dissolving a compound such as hypophophorous acid, an alkali metal hypophosphite such as potassium or sodium hypophosphite, an alkaline earth metal hypophosphite such as magnesium, calcium or barium hypophosphite, or a bivalent metal hypophosphite such as nickel hypophosphite, cobalt hypophosphite, iron hypophosphite, ferric hypophosphite, zinc hypophosphite, manganese hypophosphite, lead hypophosphite, cerium hypophosphite or cerous hypophosphite in the aqueous solution, or a mixture thereof. The reaction between the hypophosphite ion and the metal salts causes the deposition of the ferromagnetic metal or alloy. The amounts of materials added to the aqueous solution which provide hypophosphite ion preferably range from 0.001 mol/-liter to 10 mol/liter, most preferably 0.01 to 2 mol/liter. The concentration of the materials yielding hypophosphite ions in the aqueous solution is not restricted to this range but may be changed in accordance with changes of the reaction temperature, pH and the kind of the metal salts. Usually, however, the reaction temperature is from about 65° C to about 95° C and the pressure is from about 0.5 to about 5 atmospheres. Pressure is not overly critical. The pH is greater than 5, preferably 8 – 12.

In addition to the metal salts, water hypophosphite ion and an organic solvent, other components such as a pH buffering agent, complexing agent or pH buffering-/complexing agent can be added to modify the reaction conditions used. The ph buffering agent can be added to prevent changes in pH during the course of the reaction, and the complexing agent can be added to prevent any precipitation during reaction. The pH buffer/complexing agent serves both functions.

As examples of suitable pH buffering and complexing agents, there are formic acid, acetic acid, propionic acid, butyric acid, valeric acid, acrylic acid, trimethylacetic acid, benzoic acid, chloracetic acid or like monocarboxylic acids or monocarboxinates.

Examples of complexing agents which can be used in the present invention include succinic acid, malonic acid, maleic acid, itaconic acid, p-phthalic acid and like dicarboxylic acids and dicarboxylic acid metal esters, or glycolic acid, lactic acid, salicylic acid, tartaric acid, citric acid or like oxycarboxylic acids and metal oxycarboxylic acid esters.

Representative of the metal esters of monocarboxylic acids, dicarboxylic acids or oxycarboxylic acids referred to above are those wherein the metal is an alkali metal such as sodium, potassium, etc., or an alkaline earth metal such as magnesium, calcium, etc.

Boric acid, carbonic acid, sulfurous acid and like acids may be used as pH-buffering and adjusting agents. The pH buffering agent, complexing agent, etc. are usually added to elevate the pH to a pH greater than pH 5, preferably pH 8 – 12.

Other inorganic acids, organic acids, ammonium and alkali hydroxides can be used as the pH adjusting materials, e.g., inorganic acids such as sulfuric acid, hydrochloric acid or nitric acid, organic acids such as acetic acid, succinic acid, malonic acid, maleic acid, itaconic acid or p-phthalic acid, alkali metal hydroxides such as sodium hydroxide or potassium hydroxide, etc.

These compounds can be added to the aqueous solution to assist the reducing reaction. Some of these compounds may effect two or more actions, for example, some of them serve not only as a complexing agent but also as a pH buffer.

By adding ions of precious metals, such as Pd, Au, Ag or Pt, to the reaction bath as nuclei to initiate the reaction and adding the organic solvent, which is peculiar to this invention, to the reaction bath, the ferromagnetic metal powder can be reduced and deposited directly from the reaction bath. Usually the initiator is used in an amount of from $1 \times 10^{-6}$ to $1 \times 10^{-1}$ moles per liter, preferably $1 \times 10^{-5}$ to $1 \times 10^{-3}$ moles per liter.

There is no particular limitation on the types of organic solvents which can be used in the present invention to percipitate the ferromagnetic powders. The organic solvent must, of course, have a melting point lower than the reaction temperature and must be completely soluble in the aqueous solution. Further, the organic solvent must not react with any of the components of the aqueous bath at the reaction temperature. Other than this, any organic solvent which is not unduly volatile may be used. However, by using certain organic solvents as explained in detail below, extremely preferred results are obtained in that the characteristics of the ferromagnetic powder obtained can be adjusted by the selection of the solvent or solvents used.

Examples of organic solvents added to the reaction bath include methyl alcohol, ethyl alcohol, propyl alcohol, butyl alcohol, benzyl alcohol, furfuryl alcohol, ethylene glycol and like alcohols; acetone, methyl ethyl ketone, diethyl ketone, methyl isobutyl ketone and like ketones; phenol, cresol and like phenols; benzene toluene, xylene and like aromatic hydrocarbons; tetrachloroethylene, carbon tetrachloride, halogenated hydrocarbon such as tetrachloroethylene, carbon tetrachloride, Freon, and the like; methyl formate, methyl acetate, ethyl acetate, butyl acetate, ethyl propionate, ethyl butyrate, methyl tartarate and like esters between a lower fatty acid such as formic acid, acetic acid, glacial acetic acid, propionic acid, glycolic acid, etc. and an alcohol; ethylene diamine, pyridine, triethanolamine and like amines; formic acid, acetic acid, propionic acid and like lower fatty acids. These organic solvents must have the melting point lower than the temperature of the reacting bath.

The amount of organic solvent or mixture thereof which is added to the reacting bath is preferably in the range of 0.01 – 5 mol/l of all other components of the bath, i.e., the aqueous bath without organic solvent.

The addition of the alochols, ketones, phenols, esters, aromatic hydrocarbons or amines to the reaction bath improves the squareness ratio of the hysteresis loop resulting ferromagnetic metal or alloy powder. The addition of the alcohols or esters to the reaction bath increases the coercive force of the resulting ferromagnetic metal or alloy powder, and the coercive force can be adjusted in the range of 700 – 1200 o.e. by controlling the amount of the alcohol or ester. On the other hand, the halogenated hydrocarbons, the lower fatty acids and the phenols improve the squareness ratio of the hysteresis loop but decrease the coercive force.

The coercive force can be controlled to be within the range of 300 – 700 o.e. by changing the amount of the halogenated hydrocarbons, the lower fatty acids or the phenols. In order to obtain ferromagnetic metal or alloy particles having the desired magnetic properties, a suitable organic solvent or mixture of solvents is selected.

The organic solvent may be added to the reaction bath at any time before or after the start of the reducing reaction, but preferably it is added at the start of the reducing reaction.

Preferred solvents within the above classes are alcohols of from 1 to 10 carbon atoms, ketones of the formula

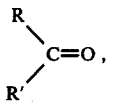

wherein R is $C_nH_{2n+1}$, R' is $C_mH_{2m+1}$, $n$ is an integer of from 1 to 4 and $m$ is an integer of from 1 to 4, phenols where the aromatic nucleous has from 1 to 3 hydroxyl groups, aromatic hydrocarbon wherein the benzene ring has an alkyl group having from 1 to 3 carbon atoms, chlorinated hydrocarbons wherein the hydrocarbon contains from 1 to 3 carbon atoms substituted with from 1 to 4 chlorine atoms, and lower fatty acids having from 1 to 10 carbon atoms.

The magnetic field applied to the reaction bath can be a direct current magnetic field, a pulsing magnetic field or an alternating current magnetic field, and the pulsing magnetic field is effective to reduce the size of the resulting ferromagnetic powder without worsening the uniformity or toughness of the resulting ferromagnetic powder. Generally a magnetic field of 10 - 10,000 oersteds (oe), preferably 500 - 5,000 oe, provides best results.

Preferred bounds exist for the magnetic field used, i.e., a pulsing field of 10 - 10,000 oe, preferably 500 - 5,000 oe, and a pulsing time of 0.1 milli second - 10 seconds with and internal time of 1/10 - 100 times the pulsing time. The magnetic field is applied during the whole reaction period.

In the case that the ferromagnetic metal powder obtained under a pulsing magnetic field is used to produce a recording tape, the surface of the tape is improved for such use and the electromagnetic performance of the tape is greatly improved, i.e., the information conversion capability.

The effective pH for the reducing reaction of the process of this invention is greater than 5, preferably from 8 - 12.

The temperature for the reducing reaction is not particularly restricted, but reaction is usually conducted between $-10°$ to 100° C, preferably 65° to 95° C.

The ferromagnetic metal powder obtained by the process of this invention has the coercive force (Hc) of more than 300 oe and a saturated magnetism ($4\pi IS$) of more than 8,000 G/cc, and comprises as a main component Co and/or Ni and several percent of P, e.g., usually 0.5 - 15 percent by weight based on powder weight. The desired grain size of the ferromagnetic metal or alloy powder is obtained by changing the reacting conditions, e.g., at higher temperatures larger grains are obtained. The grain size is generally 100A to 2$\mu$ at the temperature ranges provided above.

According to the process of this invention the squareness ratio of the hysteresis loop of the ferromagnetic metal or alloy powder obtained is remarkably increased, the coercive force can be controlled within the range of 300 - 1200 oe by selecting the kind of the organic solvent, the grain size of the powder can be kept uniform, the ratio of the length to the width of the powder grains can be increased, and the strength and toughness of rod shaped powder grain is increased, whereby the dispersion of the powder in a binder and the magnetic orientation of the powder after coating are much improved, and a magnetic recording material made from the ferromagnetic metal powder has an extremely high squareness ratio.

The magnetic properties of the ferromagnetic metal or alloy powder obtained by the process of this invention are further improved by heating in a non-oxidizing environment, e.g., in a vacuum or in a flowing $N_2$, $CO_2$ CO or $H_2$ gas stream and the oxidation resistance of the ferromagnetic powder can be improved by heating the latter in an atmosphere containing very small amounts of moisture and oxygen. The conditions used are the same described on Japanese Patent Publication No. 16052/1972 (published December 5, 1972), that is, heating temperature at greater than 100° C, preferably more than 200° C for 30 minutes - 24 hours at a pressure less than 100 torr.

The ferromagnetic powders of this invention preferably have a grain size distribution with the range of 100A - 2 $\mu$.

Particular embodiments of this invention will now be illustrated by several examples and comparative examples, where operation was always under atmospheric pressure unless otherwise indicated. All grain sizes were determined using an electron microscope and X-ray diffraction.

EXAMPLE 1

| Liquid A | | Liquid B | | Liquid C | | Liquid D | |
|---|---|---|---|---|---|---|---|
| Co chloride | 10g | Na hypo-phosphorite | 20g | Pd chloride 0.03% aqueous solution (by) weight) | 10cc | n-Butyl alcohol | 50cc |
| Na tartarate | 50g | Water | 50cc | | | | |
| Boric acid | 15g | | | | | | |
| Water | 300cc | | | | | | |

Liquid A, Liquid B and water were mixed with each other to obtain 500 cc of an aqueous solution and the pH of the solution was adjusted to 8.5 - 9.0 by adding an aqueous caustic soda solution. Liquid C was then added to the resulting solution while keeping the temperature of the solution at 90° C, a direct current magnetic field of 2,000 Gauss was applied to the solution and the solution agitated. Liquid D was successively added to the solution and the pH of the solution obtained was again adjusted to 8.5 - 9.0, continuing magnetic field application and agitation until the precipitation was complete. $H_2$ gas bubbles occurred while reacting because of the use of hypophosphite. The precipitate caused by the reducing reaction was washed with water and dried to obtain 2.4 g of ferromagnetic alloy powder. The mean length of the powder grains was 1.2 $\mu$ and the ratio of the length to the width of the grains was about 8:1, each grain being shaped like a rod. The coercive force and the saturated magnetism were 650 oe and 15,000 G/cc, respectively.

The ferromagnetic metal powder obtained was dispersed in a coating liquid containing a binder composed mainly of a vinyl chloride vinyl acetate copolymer in an amount of 3 times the amount of powder by weight (8% by weight in butylacetate of binder (6 g) and ferromagnetic metal powder (2 g), and the dispersion was coated on a plastic film to produce a magnetic recording tape.

The squareness ratio of the hysteresis loop of the magnetic recording tape was 0.85.

COMPARATIVE EXAMPLE 1

A ferromagnetic alloy powder was produced according to the same process as described in Example 1 except Liquid D was not added to Liquid A, Liquid B and Liquid C. The amount of powder produced was also 2.4 g, but the powder had a mean grain length of 2.5 $\mu$ and a ratio of length to width of about 6:1. The powder grain was thus shaped like a large rod. The magnetic properties of the ferromagnetic alloy powder were almost equal to those of the powder obtained in Example 1.

The squareness ratio produced with this ferromagnetic metal powder was 0.70. Although the magnetic properties of this powder were almost equal to those of the powder obtained in Example 1, the magnetic properties of the resulting magnetic tape made from this powder were considerably reduced as compared with those of the magnetic tape made from the powder in Example 1. This result was considered to be caused by the difference between the grain sizes of the powders, and therefore both magnetic layers on both tapes were inspected and compared by a scanning type electron microscope. As a result of electron microscope inspection it was found the powder of Example 1 exhibited grains of a slender rod like shape and a uniform grain size distribution, and the grains were scarcely broken after being mixed with and dispersed in the binder to produce the magnetic tape but the powder of Comparative Example 1 exhibited grains shaped like rough of rods and a varying grain size distribution, and the grains were broken after being mixed with and dispersed in the binder, thus bringing out the remarkable difference between the squareness ratios of both magnetic tapes.

As particularly described above, the addition of the alcohol to the reacting system just at the start of the reducing reaction is effective to render the grain size uniform, to increase the ratio of the length to the width of the grain, to minimize the length of the grain and to render the rod shaped powder grain strong and tough.

COMPARATIVE EXAMPLE 2

A ferromagnetic metal powder was produced as in Example 1 except that a magnetic field was not applied.

The coercive force and the saturated magnetism of the ferromagnetic powder obtained were 440 oe and 14,000G, respectively, and the length of each powder grain was about 0.1 $\mu$. The powder grain was very fine but granular. The squareness ratio of the magnetic tape produced by dispersing the ferromagnetic powder into the binder was less than 0.5.

The addition of the organic solvent thus turned out to be effective only when the magnetic field was applied.

The total reaction time was 10 minutes. The product had the following composition:

Co: 82.3%

P: 9.6%

The product contained a small amount of hydroxide and oxide.

EXAMPLE 2

A ferromagnetic metal powder was produced according to the same process as in Example 1 except for changing the time that Liquid D was added. The results are given below.

1. Liquid D was added to the solution mixture before the addition of Liquid C. The squareness ratio of the resulting ferromagnetic powder was 0.75. The addition of Liquid D in this sequence did not cause such a remarkable effect, but the magnetic properties were slightly improved as compared with the case of not using Liquid D.

2. Liquid D was added to the solution mixture together with Liquid C. The squareness ratio of the resulting ferromagnetic powder, the mean grain size and the ratio of the length to the width of the grain were 0.80, 1.2 $\mu$ and 7:1, respectively. The grain size was uniform. The addition of Liquid D turned out to be fully effective.

3. Liquid D was added before the generation of $H_2$ gas bubbles in the reaction bath and after the addition of Liquid C. The squareness ratio of the resulting ferromagnetic powder, the mean grain size and the ratio of the length to the width of the grain were 0.85, 1.3 $\mu$ and 8:1, respectively. The grain size was uniform, and the addition of Liquid D turned out to be very effective.

4. Liquid D was added to the reaction immediately after the generation of $H_2$ gas bubbles therein. The squareness ratio of the resulting ferromagnetic powder, the mean grain size and the ratio of the length to the width of the grain were 0.85, 1.2 $\mu$ and 8:1, respectively. The grain size was almost uniform. The effect of the addition of Liquid D was fully recognized.

5. Liquid D was added to the reaction bath after the generation of $H_2$ gas bubbles therein by the addition of Liquid C. The squareness ratio of the resulting ferromagnetic powder, the mean grain size and the ratio of the length to the width of the grain were 0.85, 1.4 $\mu$ and 8:1, respectively. The distribution of the grain size was not so smooth and uniform.

The addition of the organic solvent is preferably carried out at the same time as, or immediately after, the addition of Liquid C. The most preferred results will be obtained by adding the organic solvent in the period between the addition of Liquid C and the start of the $H_2$ gas bubble generation due to the hypophosphite. This results in the production of a ferromagnetic powder having a satisfactory squareness ratio and a uniform grain size distribution. The time to add Liquid B and to add Liquid C may be reversed with the same results.

EXAMPLE 3

| | | |
|---|---|---|
| Liquid A | Ni acetate | 6 g |
| | Co acetate | 10 g |
| | Na tartarate | 50 g |
| | Boric acid | 15 g |
| | Water | 300 cc |
| Liquid B | Na hypophosphite | 20 g |
| | Water | 50 cc |
| Liquid C | Pd chloride 0.03% aq. solution | 15 cc |
| Liquid D | Alcohols | 50 cc |

(methyl alcohol, ethyl alcohol, isopropyl alcohol, n-butyl alcohol, benzyl alcohol, furufuryl alcohol or ethylene glycol as shown in Table 1)

Liquid A, Liquid B and water were mixed with each other to obtain 500 cc of an aqueous solution, and the pH of this solution was adjusted to 9.0 by adding an aqueous caustic soda solution. Liquid C was then added to the resulting solution keeping the temperature at 90° C. A direct current magnetic field of 2,000G was applied to the solution throughout the precipitation and the solution also agitated throughout the precipitation. Liquid D was then added to the solution and the pH was adjusted to be 8.5 – 9.0.

The precipitate caused by the reducing reaction was washed with water and dried to obtain the ferromagnetic metal powder which exhibited a uniform grain size distribution and a large ratio of length to width of the powder grain. The powder grains were observed to be very fine, strong and tough. The resultant ferromagnetic metal powder was dispersed in a binder (8% by weight butylacetate solution of ferromagnetic metal powder 5 g and vinylchloride vinylidene chloride copolymer 5 g) and formed into a magnetic recording tape. The squareness ratio and the coercive force of the magnetic tape were greater than 0.8 and greater than 7000 oe, respectively, as shown in Table 1.

It will be apparent from this example that the addition of the alcohols to the reaction bath yields good magnetic properties, and especially the addition of the lower alcohols yields a ferromagnetic metal powder having an excellent squareness ratio.

Comparing the specimens of Example 1 with those of Example 2 in a case of using butyl alcohol, the ferromagnetic powder obtained from the Co-Ni containing bath exhibited a higher coercive force than that of the ferromagnetic powder obtained from the Co containing bath.

Table 1

| Organic solvent | Grain size (μ) | Coercive force (oe) | Squareness ratio (Br/Bs) |
|---|---|---|---|
| *— | 2.5 | 600 | 0.70 |
| methyl alcohol | 1.0 | 900 | 0.88 |
| ethyl alcohol | 1.1 | 850 | 0.86 |
| isopropyl alcohol | 1.2 | 800 | 0.86 |
| n-butyl alcohol | 1.2 | 720 | 0.85 |
| benzyl alcohol | 1.5 | 700 | 0.80 |
| furfuryl alcohol | 1.5 | 710 | 0.82 |
| ethylene glycol | 1.7 | 720 | 0.80 |
| *n-butyl alcohol | 1.2 | 650 | 0,85 |

*Comparative specimens in Example 1.

| Organic solvent | Reaction time (min.) | Product composition* Co (%) | Ni (%) | P (%) | Note |
|---|---|---|---|---|---|
| — | 12 | 83.5 | — | 9.2 | Comparative Example 1 |
| methyl alcohol | 10 | 56.2 | 35.7 | 5.0 | Example 3 |
| ethyl alcohol | 10 | 56.0 | 35.8 | 4.8 | Example 3 |
| isopropyl alcohol | 10 | 56.5 | 35.8 | 4.7 | Example 3 |
| n-butyl alcohol | 10 | 56.7 | 35.7 | 4.6 | Example 3 |
| benzyl alcohol | 12 | 56.7 | 35.9 | 4.4 | Example 3 |
| furfuryl alcohol | 12 | 56.9 | 36.0 | 4.4 | Example 3 |
| ethylene glycol | 15 | 56.2 | 36.0 | 4.6 | Example 3 |
| n-butyl alcohol | 10 | 85.0 | — | 8.6 | Comparative Example 1 |

In each case, the product contained a small amount of a hydroxide and an oxide.

EXAMPLE 4

| | | |
|---|---|---|
| Liquid A | Ni sulfamate | 5 g |
| | Co sulfamate | 10 g |
| | Boric acid | 15 g |
| | Water | 300 cc |
| Liquid 3 | Na hypophosphite | 20 g |
| | Water | 50 cc |
| Liquid C | Chloroauric acid (0.03% aq. solution) | 20 cc |
| Liquid D | Acetone | 20 cc |

Liquid A, Liquid B and water were mixed with each other to obtain 500 cc of an aqueous solution, and the pH of this solution was adjusted to 9.0 C by adding an aqueous caustic soda solution. Liquid C was then added to the resulting solution keeping the temperature at 90° C and applying a direct current magnetic field of 2000G to the solution while agitating the solution. Liquid D was added to the solution immediately after $H_2$ bubbles were generated in the reaction bath and the pH of the solution was again adjusted to 8.5 – 9.0. The magnetic field was applied throughout the precipitation in combination with agitation. The precipitate caused by the reducing reaction was washed with water and dried to obtain the ferromagnetic alloy powder, which was composed of rod shaped grains having a mean grain size of 1.5 μ and a length: width ratio of about 15:1. The coercive force and the saturated magnetism ($4\pi IS$) of the alloy powder were 1,200 oe and 11,000 Gcc, respectively. This ferromagnetic metal powder was dispersed in a binder and formed into a magnetic tape which exhibited a squareness ratio of 0.85.

Upon inspection of the ferromagnetic alloy powder by a scanning type of electron microscope, a uniform distribution of the powder grain was observed.

The total reaction time was 10 minutes. The product had the following composition: Co (62.3%), Ni (30.2%), P (4.0%) and contained a small amount hydroxide and oxide.

COMPARATIVE EXAMPLE 3

A ferromagnetic alloy powder was produced according to the process of Example 4 except a magnetic field was not applied to the reaction bath.

The coercive force and the saturated magnetism of the obtained ferromagnetic alloy powder were 480 oe and 11,000G, respectively. The grains were very fine but granular (having from a size of 0.1 μ). The squareness ratio of the magnetic tape produced from this ferromagnetic alloy powder dispersed in the binder was less than 0.5.

It will be apparent from these results that the effect of the addition of the organic solvent is brought out by the application of the magnetic field.

EXAMPLE 5

Ferromagnetic alloy powders were produced, following the procedures of Examples 1 and 4 but by changing the kind of magnetic field, i.e., using; 1. a pulsing magnetic field; 2. an alternating current magnetic field, and 3. ultrasonic waves and a direct current magnetic field.

The grain size and the squareness ratio of the magnetic hysteresis loop of the alloy powders obtained were measured.

The results are shown in Table 2 (according to the process of Example 1 where total reaction time was 10 minutes) and Table 3 (according to the process of Example 4 where total reaction time was 10 minutes.

Table 2

| Magnetic field applied | | Grain size (μ) | Squareness ratio |
|---|---|---|---|
| Direct current magnetic field(2000G) | | 1.2 | 0.85 |
| Direct current magnetic field(1000G) +ultrasonic waves (40KHZ) | | 1.0 | 0.85 |
| Alternating current magnetic field (50HZ, 2000G) | | 1.0 | 0.85 |
| Pulsed magnetic field* | (1 sec,10) | 1.0 | 0.85 |
| " | (1 sec,1) | 0.8 | 0.82 |
| " | (1 sec,1/5) | 0.5 | 0.80 |
| " | (1 sec,1/10) | 0.3 | 0.60 |
| " | (1 sec,1/100) | 0.2 | <0.50 |
| " | (100msec,**,10) | 0.6 | 0.85 |
| " | (100msec,1) | 0.5 | 0.84 |
| " | (100msec,1/5) | 0.4 | 0.82 |
| " | (100msec,1/10) | 0.3 | 0.70 |
| " | (10msec,1) | 0.4 | 0.83 |
| " | (10msec,1/5) | 0.3 | 0.81 |
| " | (10msec,1/10) | 0.3 | 0.80 |
| " | (1msec,1) | 0.3 | 0.82 |
| " | (1mesc,1/5) | 0.2 | 0.80 |

*all pulsed magnetic field values were of 2000G
**msec means milliseconds

The numerals in the parentheses for the pulse magnetic field show the pulse width and the ratio of pulse width to the interval between pulses. For example, (10msec, 1/5) means the magnetic field where the field was applied for 10m sec and stopped for 1/5 × 10m sec, (1 sec, 10) means 1 second pulses spaced by 10 second intervals, etc.

The numerals in the middle column of "grain size" indicate the length of the rod shaped powder grain.

Table 3

| Magnetic field applied | | Grain size (μ) | Squareness ratio |
|---|---|---|---|
| Direct current magnetic field | | 1.5 | 0.85 |
| Direct current magnetic field(1000G) + ultrasonic wave (40KHZ) | | 1.2 | 0.84 |
| Alternating current magnetic field (50 HZ, 2000G) | | 1.2 | 0.84 |
| Pulsed magnetic field | (1 sec,10) | 1.3 | 0.85 |
| " | (1 sec,1) | 0.9 | 0.84 |
| " | (1 sec,1) | 0.9 | 0.84 |
| " | (1 sec,1/5) | 0.6 | 0.80 |
| " | (1 sec,1/10) | 0.3 | 0.65 |
| " | (1 sec,1/1000) | 0.2 | <0.50 |
| " | (10msec,1) | 0.5 | 0.82 |
| " | (10msec,1/5) | 0.3 | 0.80 |
| " | (10msec,1/10) | 0.3 | 0.70 |

*all pulsed magnetic fields were of 2000G

It will be apparent from the results shown in Table 2 and Table 3 that the application of a pulsed magnetic field or an alternating current magnetic field or the combined application of a direct current magnetic field and ultrasonic waves are effective for reducing the size and shortening the powder grain length. The application of a pulsed magnetic field is especially effective, and the shorter the pulse width is, the finer the powder grains obtained are.

The accicularity of the powder grains was sharply reduced at a pulse width of 1m sec – 1 sec and at a ratio of the pulse width to the interval of less than 1/10.

The strength and toughness of the powder grains formed with the application of a pulsed magnetic field were excellent, as well as those formed with the application of a direct current magnetic field.

The squareness ratio of a magnetic tape produced from the ferromagnetic metal powders dispersed in a binder was greater than 0.8, and the pulse width/interval ratio was more than 1/5. Inspection of the powder grains by a scanning electron microscope showed that the grain size distribution was smooth and uniform.

EXAMPLE 6

| | | |
|---|---|---|
| Liquid A | Ni sulfate | 6 g |
| | Co sulfate | 10 g |
| | Na citrate | 50 g |
| | Boric acid | 300 cc |
| Liquid B | Na hypophosphite | 20 |
| | Water | 50 cc |
| Liquid C | Pd chloride 0.03% aq. solution | 20 cc |
| Liquid D | Organic solvent (see Table 4) aqueous solution | 50 cc |

(5 – 20 g of organic solvent was dissolved in water to obtain 50 cc of solution)

Liquid A, Liquid B and water were mixed with each other to obtain 500 cc of an aqueous solution, and an aqueous caustic soda solution was added to the obtained solution to adjust the pH to 9.0. Then Liquid D was added to the solution while agitating and keeping the latter at 90° C. A direct current magnetic field of 2,000G was applied during the precipitation. While Liquid D was added to the solution the pH was adjusted to 8.5 – 9.0. The reducing reaction was continued until precipitation was completed, and the precipitate then washed with water and dried to obtain the ferromagnetic alloy powder.

The grain size, the coercive force and the squareness ratio of the hysteresis loop of the alloy powder obtained were measured and the results are shown in Table 4.

Table 4

| Organic solvent | Grain size (μ) | Coercive force(oe) | Squareness ratio(Br/Bs) | Reaction time (min.) |
|---|---|---|---|---|
| phenol 10 g | 1.6 | 640 | 0.85 | 10 |
| phenol 20 g | 1.2 | 700 | 0.90 | 10 |
| cresol 20 g | 1.5 | 600 | 0.83 | 10 |
| hydroquinone 20g | 1.6 | 580 | 0.80 | 12 |
| pyrocatechol 10g | 1.9 | 530 | 0.78 | 15 |
| pyrocatechol 20g | 1.8 | 400 | 0.82 | 15 |
| pyrogallol 5 g | 1.9 | 440 | 0.76 | 20 |
| pyrogallol 10 g | 1.8 | 380 | 0.80 | 20 |
| pyrogallol 20 g | 1.8 | 300 | 0.80 | 20 |

It will be apparent from Table 4 that the ferromagnetic alloy powders produced using phenol as the organic solvent exhibited excellent magnetic properties, i.e., a tape formed as in Example 1 using the 20 g phenol ferromagnetic powder system showed a coercive force of 700 oe, a squareness ratio of 0.90, and a favorable grain orientation with a smooth tape surface.

EXAMPLE 7

A ferromagnetic alloy powder was produced under the same conditions as in Example 6 except for replacing Liquid D with various fatty acids, carbon tetrachloride, Freon or hydrocarbons. The grain size, coercive force and the squareness ratio of the hysteresis loop of the obtained ferromagnetic alloy powder were measured. The results are shown in Table 5 along with the fatty acids, hydrocarbons, carbon tetrachloride and Freon used.

Table 5

| Organic solvent | Grain size (μ) | Coercive force(oe) | Squareness ratio(Br/Bs) | Reaction time (min.) |
|---|---|---|---|---|
| formic acid 20cc | 1.6 | 500 | 0.82 | 15 |
| glacial acetic acid 10cc | 1.6 | 530 | 0.80 | 15 |
| glacial acetic acid 20cc | 1.5 | 400 | 0.81 | 15 |
| propionic acid 20cc | 1.3 | 560 | 0.82 | 15 |
| *capric acid 20cc | 2.0 | 350 | 0.60 | 15 |
| glycolic acid 10cc | 1.3 | 550 | 0.82 | 15 |
| glycolic acid 20cc | 1.2 | 450 | 0.81 | 15 |
| **oleic acid 20cc | — | — | — | 60 |
| benzene 20cc | 1.9 | 590 | 0.83 | 10 |
| toluene 20cc | 1.6 | 600 | 0,85 | 10 |
| xylene 20cc | 1.5 | 600 | 0.85 | 10 |
| carbon tetrachloride 10cc | 1.3 | 450 | 0.79 | 15 |
| carbon tetrachloride 20cc | 1.0 | 300 | 0.80 | 15 |
| ***Freon 10cc | 1.2 | 520 | 0.80 | 15 |
| ***Freon 20cc | 1.0 | 350 | 0.80 | 15 |

*the grain shape became rectangular

**the alloy powder was not precipitated

***a mixed solvent of Freon-113 ($CCl_2FCClF_2$ made by E. I. Du Pont de Nemours & Co., Inc.) and methylene chloride ($CH_2Cl_2$) (50.5 : 49.5 by volume) was used It was concluded from the results in Table 5 that higher fatty acids insoluble in water are not suitable for producing a ferromagnetic alloy powder having a high orientation (see U.S. Pat. No. 2,711,901) or a good squareness ratio.

On the other hand, lower fatty acids soluble in water and having a low melting point generally reduced the coercive force of the ferromagnetic alloy powder, and accordingly a coercive force between 400 oe and 600 oe could be obtained by controlling the amount of the lower fatty acid.

The addition of aromatic hydrocarbons brought out a good squareness ratio and a stable coercive force in the resulting ferromagnetic powders. The addition of the halogenated hydrocarbon was effective to control the coercive force to be in the range of 300 - 600 oe.

Thus, the addition of organic solvents substantially insoluble in water or having a boiling point lower than that reaction temperature brings out the effects peculiar to the process of this invention.

EXAMPLE 8

Ferromagnetic alloy powders were produced under the same conditions as in Example 6 except for replacing Liquid D with methylethyl ketone, methylisobutyl ketone or a like ketone or esters. The grain size, the coercive force and the squareness ratio of the hysteresis loop of the obtained ferromagnetic alloy powders were measured and are listed in Table 6 along with the materials used to form Liquid D.

Table 6

| Organic solvent | Grain size (μ) | Coercive force (oe) | Squareness ratio |
|---|---|---|---|
| methylethyl ketone 10cc | 1.6 | 1,000 | 0.85 |
| methylethyl ketone 20cc | 1.5 | 1,180 | 0.84 |
| methylisobutyl ketone 10cc | 1.5 | 1,050 | 0.83 |
| methylisobutyl ketone 20cc | 1.4 | 1,200 | 0.84 |
| diethyl ketone 20cc | 1.8 | 950 | 0.85 |
| ethyl formate 20cc | 1.2 | 780 | 0.83 |
| methyl acetate 10cc | 1.2 | 730 | 0.82 |
| methyl acetate 20cc | 1.6 | 930 | 0.83 |
| ethyl acetate 20cc | 1.4 | 960 | 0.83 |
| butyl acetate 10cc | 1.5 | 910 | 0.82 |
| butyl acetate 20cc | 1.6 | 1,000 | 0.80 |
| ethyl malonate 10cc | 2.0 | 830 | 0.82 |
| diethyl phthalate 10cc | 1.7 | 700 | 0.80 |

It will be apparent from Table 6 that the ferromagnetic alloy powders produced using ketones other than acetone used in Example 4 exhibited an excellent squareness ratio and a high coercive force as did the alloy powders in Example 4. The addition of the esters was also effective as compared to the ketones, and the addition of methyl acetate and butyl acetate brought out an especially favorable squareness ratio and a coercive force of 1,000 oe.

The total reaction time = 15 min. in each case.

EXAMPLE 9

Ferromagnetic metal powders were obtained under the same conditions as in Example 6 except for replacing Liquid D with an amine. The addition of the amine yielded a stable coercive force and an excellent squareness ratio in the resulting ferromagnetic metal powders. The ferromagnetic alloy powder produced using triethanolamine exhibited a squareness ratio of 0.85 and a coercive force of 600 oe. Hc can be obtained at constant values and the reproducibility of Hc is stable.

Table 7

| Amine | Grain size (μ) | Coercive force(oe) | Squareness ratio | Reaction time (min.) |
|---|---|---|---|---|
| triethanolamine 10g | 1.2 | 600 | 0.85 | 12 |
| triethanolamine 20g | 1.1 | 600 | 0.85 | 12 |
| ethylenediamine 10cc | 1.5 | 600 | 0.82 | 10 |
| ethylenediamine 20cc | 1.3 | 600 | 0.82 | 15 |

EXAMPLE 10

Ferromagnetic metal powers were obtained under the same conditions as in Example 3 except for further adding very small amounts of special elements to the reacting bath. The resultant ferromagnetic metal powder exhibited a coercive force higher than that obtained in Example 3. More particularly, the addition of La, Ce, Nd, Sm or like rare earth elements and Al, S, Cr, Mn, Fe, Cu or Zn increased the coercive force. The combination of a suitable organic solvent and small amounts of these elements was very effective to even further increase the coercive force.

Table 8

| Additive | Amount (g) | Alcohol (Reaction time:15min) Grain size (μ) | Alcohol (Reaction time:15min) Coercive force(oe) | Isopropyl alcohol (Reaction time:10min) Grain size (μ) | Isopropyl alcohol (Reaction time:10min) Coercive force(oe) |
|---|---|---|---|---|---|
| — | — | 2.5 | 600 | 1.2 | 800 |
| $LaCl_3 . 6H_2O$ | 0.2 | 2.0 | 750 | 1.0 | 880 |
| $CeCl_3 . 7H_2O$ | 0.3 | 2.0 | 750 | 1.0 | 850 |
| $NdCl_3 . 6H_2O$ | 0.2 | 2.0 | 850 | 0.8 | 1,000 |
| $SmCl_3 . 6H_2O$ | 0.2 | 2.0 | 800 | 0.9 | 1,000 |
| $Al_2(SO_4)_3 . 18H_2O$ | 1.0 | 2.1 | 650 | 1.3 | 850 |
| $CS(NH_2)_2$ | 0.01 | 2.5 | 670 | 1.2 | 900 |
| $CrO_3$ | 0.2 | 1.8 | 660 | 0.8 | 830 |
| $MnSO_4 . 5H_2O$ | 0.3 | 2.3 | 640 | 1.1 | 860 |
| $FeSO_4 . 7H_2O$ | 0.5 | 2.0 | 700 | 1.0 | 850 |
| $CuSO_4 . 5H_2O$ | 0.1 | 2.2 | 720 | 1.1 | 900 |
| $ZnSO_4 . 7H_2O$ | 0.5 | 2.3 | 750 | 1.3 | 840 |
| $3CdSO_4 . 8H_2O$ | 0.05 | 2.5 | 580 | 1.5 | 760 |
| $RhSO_4$ | 0.01 | 2.4 | 600 | 1.2 | 800 |
| $WO_3$ | 0.03 | 2.5 | 550 | 1.2 | 650 |

While this invention has been described with reference to particular embodiments thereof, it will be understood that the numerous modifications may be made by those skilled in the art without actually departing from the spirit and scope of this invention, and therefore the appended claims are intended to cover all such equivalent variations as coming within the true spirit and scope of this invention.

What is claimed is:

1. A process for producing a ferromagnetic powder which comprises:

a. preparing an aqueous solution by (a) adding metal salts, hypophosphite ions, and precious metal ions to water; said metal salts consisting essentially of salts of nickel or cobalt or both, said metal salts also including salts of metals wherein the metal is selected from the group consisting of La, Ce, Nd, Sm, Al, S, Cr, Mn, Fe, Cu and Zn in an amount of 0 - 10% by weight of the total salts used; the concentration of total salts in the aqueous solution being in the range of 0.001 to 1 mole per liter and adjusting the pH to greater than 5, (b) adding an organic solvent to the aqueous solution at the same time said metal salts, hypophosphite ions and said precious metal ions are added to said water or up to the time immediately after the commencement of a hydrogen gas evolution which accompanies the reaction of said metal salts and hypophosphite ions; said organic solvent being non-reactive with the metal salts or hypophosphite ions, said organic solvent having a melting point lower than 65° C;

2. reacting and reducing the metal salts with the hypophosphite ions to form a precipitate by heating the aqueous solution to a temperature of 65° to 95° C, applying a pressure of 0.5 to 5 atmospheres, and subjecting the aqueous solution to a magnetic field of from 10 to 10,000 oe;
3. collecting the precipitate obtained in (2); and
4. washing the precipiate of (3).

2. The process of claim 1, wherein said organic solvent is added to said water before the commencement of step (2) and the generation of hydrogen gas bubbles.

3. The process of claim 1 wherein the organic solvent is an alcohol, a ketone, a phenol, an aromatic hydrocarbon, a halogenated hydrocarbon, an ester, an amine or a water-soluble fatty acid.

4. The process of claim 3, wherein the organic solvent is an alcohol of from 1 to 10 carbon atoms.

5. The process of claim 3, wherein the organic solvent is a ketone of the formula

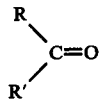

wherein R is $C_nH_{2n+1}$, R' is $C_mH_{2m+1}$, *m* and *n* are an integer from 1 to 4.

6. The process of claim 3, wherein the organic solvent is a phenol wherein the aromatic nucleus contains from 1 to 3 hydroxyl groups.

7. The process of claim 3, wherein the organic solvent is a benzene aromatic hydrocarbon wherein the benzene ring contains an alkyl group having from 1 to 3 carbon atoms.

8. The process of claim 3, wherein the organic solvent is a chlorinated hydrocarbon having from 1 to 3 carbon atoms.

9. The process of claim 1, wherein the organic solvent is a water-soluble fatty acid having from 1 to 10 carbon atoms.

10. The process of claim 1 wherein the amount of organic solvent added is in the range of 0.01 to 5 mol/-liter of the aqueous solution excluding organic solvent.

11. The process of claim 1 where the alkali metal hypophosphite is sodium hypophosphite or potassium hypophosphite, the alkaline earth metal hypophosphite is magnesium hypophosphite, calcium hypophosphite or barium hypophosphite, and the divalent metal hypophosphite is nickel hypophosphite, cobalt hypophosphite, iron hypophosphite, ferric hypophosphite, zinc hypophosphite, manganese hypophosphite, lead hypophosphite, cerium hypophosphite or cerous hypophosphite.

12. The process of claim 1, wherein in step (1)(a) phosphorus is added to the aqueous solution.

13. The process of claim 1, wherein the salts of the metals selcted from the group consisting of La, Nd, Sm, Al, S, Cr, Mn, Fe, Cu and Zn are sultates, chlorides, nitrates, formates, acetates, sulfamates or pyrophosphates.

14. The process of claim 1, wherein the hypophosphite ions are added to the water in the form of adding thereto hypophosphorus acid, an alkali metal-hypophosphite, an alkaline earth metal-hypophosphite or a divalent metal-hypophosphite.

15. The process of claim 1, wherein the salts of nickel or cobalt or both are selected from the group consisting of sulfates, chlorides, nitrates, formates, acetates, sulfamates and pyrophosphates; wherein said salts are added to said water to provide an amount of from 0.001 to 0.5 mol per liter; wherein said hypophosphite ions are added to said water in the form of adding thereto hypophosphorous acid, an alkali metal-hypophosphite, an alkaline earth metal-hypophosphite or a divalent metal-hypophosphite and are added in an amount to provide a concentration of 0.001 to 10 mols per liter; wherein the organic solvent is selected from the group consisting of methyl alcohol, ethyl alcohol, propyl alcohol, butyl alcohol, benzyl alcohol, furfuryl alcohol, ethylene glycol, acetone, methyl ethyl ketone, diethyl ketone, methyl isobutyl ketone, phenol, cresol, benzene, toluene, xylene, tetrachloroethylene, carbon tetrachloride, methyl formate, methyl acetate, ethyl acetate, butyl acetate, ethyl propionate, ethyl butyrate, methyl tartarate, ethylene diamine, pyridine, triethanolamine, formic acid, acetic acid, propionic acid and trichlorotrifluoroethane and is added to said aqueous solution in an amount to provide a concentration of 0.05 to 5 mols per liter of the aqueous solution; wherein the pH of the aqueous solution of step (1)(b) is adjusted to from 8 to 12; and wherein said precious metal ions are selected from the group consisting of Au, Ag, Pd and Pt and are added to the water to provide a concentration of from $1 \times 10^{-6}$ to $1 \times 10^{-1}$ mols per liter.

16. The process of claim 15, wherein step (1) consists of adding metal salts of nickel or cobalt or both, hypophosphite ions, and the organic solvent to the water.

17. The process of claim 15, wherein the precious metal ions are selected from the group of Au, Ag, Pd and Pt.

18. The process of claim 17, wherein said precious metal ions are added to the water to provide a concentration of $1 \times 10^{-6}$ to $1 \times 10^{-1}$ mols per liter.

* * * * *

UNITED STATES PATENT AND TRADEMARK OFFICE

CERTIFICATE OF CORRECTION

PATENT NO. : 4,059,463

DATED : November 22, 1977

INVENTOR(S) : Masashi AONUMA et al

It is certified that error appears in the above-identified patent and that said Letters Patent are hereby corrected as shown below:

In the Heading,

RELATED U.S. APPLICATION DATA:

Delete "Continuation-in-part of Ser. No. 326,358, Jan. 24, 1973, abandoned, which is a continuation of Ser. No. 552,013, Feb. 24, 1975, abandoned."

and INSERT

----- Continuation of Ser. No. 552,013, Feb. 24, 1975, abandoned, which is a continuation of Ser. No. 326,358, Jan. 24, 1973, abandoned -----

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*